US007544876B2

(12) United States Patent
Toyama

(10) Patent No.: US 7,544,876 B2
(45) Date of Patent: Jun. 9, 2009

(54) KEYBOARD APPARATUS OF ELECTRONIC KEYBOARD INSTRUMENT

(75) Inventor: Yutaka Toyama, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 11/820,448

(22) Filed: Jun. 18, 2007

(65) Prior Publication Data

US 2007/0295193 A1 Dec. 27, 2007

(30) Foreign Application Priority Data

Jun. 21, 2006 (JP) ..... 2006-171216

(51) Int. Cl.
*G10C 3/12* (2006.01)

(52) U.S. Cl. ..... 84/433; 84/434; 84/435; 84/423 R

(58) Field of Classification Search ..... 84/423 R, 84/433–435
See application file for complete search history.

(56) References Cited

U.S. PATENT DOCUMENTS

| | | | | |
|---|---|---|---|---|
| 3,032,455 | A * | 5/1962 | Fauser | 428/120 |
| 3,570,359 | A * | 3/1971 | Ohno | 84/423 R |
| 3,979,990 | A * | 9/1976 | Hinago | 84/719 |
| 4,364,297 | A * | 12/1982 | Meier | 84/440 |
| 4,914,999 | A * | 4/1990 | Masubuchi et al. | 84/423 R |
| 5,131,308 | A * | 7/1992 | Katsuta | 84/434 |
| 5,929,357 | A * | 7/1999 | Masubuchi | 84/423 R |
| 6,051,768 | A * | 4/2000 | Masubuchi | 84/433 |
| 6,087,576 | A * | 7/2000 | Masubuchi | 84/433 |
| 6,133,517 | A * | 10/2000 | Masubuchi | 84/423 R |
| 7,297,855 | B2 * | 11/2007 | Nishida | 84/423 R |
| 7,326,844 | B2 * | 2/2008 | Nishida | 84/423 R |
| 2007/0295192 | A1 * | 12/2007 | Watanabe | 84/423 R |
| 2007/0295193 | A1 * | 12/2007 | Toyama | 84/423 R |
| 2009/0007756 | A1 * | 1/2009 | Osuga | 84/423 R |

FOREIGN PATENT DOCUMENTS

| | | |
|---|---|---|
| JP | 6-31507 | 8/1994 |
| JP | 2628656 | 4/1997 |
| JP | 2001-265348 | 9/2001 |

* cited by examiner

*Primary Examiner*—Jeffrey Donels
*Assistant Examiner*—Robert W Horn
(74) *Attorney, Agent, or Firm*—Morrison & Foerster LLP

(57) ABSTRACT

A keyboard apparatus of an electronic keyboard instrument, which is compact in size and broad in a permissible movable range at the time of receiving a force exerting in a width direction of keys. The keyboard apparatus includes key main bodies each provided with a key-fulcrum function device permitting a key to be pivotable in the key depression/release direction and including a vertical hinge and a left-to-right hinge. The vertical hinge is formed into a thin plate-like piece member extending downward of the key and coupled to a common base end and the left-to-right hinge, which is formed into a thin plate-shaped piece member extending along the longitudinal direction of the key and coupled to a connecting portion that is formed into a plate shape extending downward of the key and coupled to the key main body.

3 Claims, 7 Drawing Sheets

KEYBOARD APPARATUS OF ELECTRONIC KEYBOARD INSTRUMENT

BACKGROUND OF THE INVENTION

1. Field of the Invention

The present invention relates to a keyboard apparatus of an electronic keyboard instrument, and more particularly, to the structure of a key-fulcrum function device of a keyboard apparatus and miniaturization of the keyboard apparatus.

2. Description of the Related Art

In electronic keyboard instruments such as portable keyboard, synthesizer, electronic organ, and electronic piano, a conventionally known keyboard apparatus includes a plurality of key units which are stacked together and fixed to a key frame and each of which is comprised of a plurality of keys (for instance, see FIGS. 2 and 3 of Japanese Patent Publication No. 2628566).

FIGS. 5A and 5B are schematic views for explaining a problem of a conventional key unit.

By way of example, the conventional key unit includes one-octave keys that are divided into a first structure (black key unit) having a plurality of black keys and a plurality of second structures (e.g., a white key unit comprised of four keys of C, E, G, and B and another white key unit comprised of three keys of D, F, and A), in each of which at least every two white keys are formed into a comb-teeth like shape. The keys of each key unit have rear ends thereof coupled together into a common base end and integrally formed by resin molding. The key units are stacked together at their common base ends and fixed to a key frame.

Referring to FIG. 5A, a plurality of key main bodies 51 to 53 forming a white key unit have rear ends thereof fixed to a band-like common base end 54 via horizontal hinges 51*a* to 53*a* which can be elastically deformed. The key main bodies 51 to 53 are capable of being pivoted around the horizontal hinges 51*a* to 53*a* in the key depression/release direction.

Reference numerals 55 to 57 denote guide portions (key guides) which are formed in the key frame, not shown, so as to project along back surfaces of the key main bodies 51 to 53. These key guides 55 to 57 limit displacements of the key main bodies 51 to 53 in the width direction (the left-to-right direction) of the keys and also limit the rolling of the key main bodies 51 to 53 around the longitudinal axes (extending in the depth direction) of the keys.

However, in the molding of the key unit, there is caused an error from the design dimension or a deformation of the key unit due to post shrinkage thereof or the like. If such an error or deformation is caused in the key main bodies 51 to 53 or the common base end 54, an undesired force is locally exerted when the key unit in which an error or deformation is caused is forcibly mounted to the key frame.

For instance, if the key main body 53 is deformed, the deformed key main body 53 causes the horizontal hinge 53*a* to be deformed in the width direction of the key, as shown in FIG. 5B, which in turn causes another key to be deformed via the common base end 54. As a result, the key guides 55 to 57 are in urged contact with the back surfaces of the key main bodies 51 to 53 at locations a, b, and c. This is also true in a case where illustrated portions d and e of the common base end 54 are deformed. As a consequence, bad effects are caused such that the key main bodies 51 to 53 are rubbed against the key guides 55 to 57 or the adjacent key main bodies are rubbed against from each other.

FIG. 6 is a view of a key for explaining another problem of the conventional key unit (see, FIGS. 1 and 4 of Japanese Patent Publication No. 2628566).

In FIG. 6, reference numeral 61 denotes a key main body, 61*a* denotes a horizontal hinge whose rear end can be elastically deformed to permit the key main body 61 to be pivotable, 61*b* denotes a left-to-right hinge capable of being elastically deformed to permit the key main body 61 to be displaceable in the width direction of the key, and 62 denotes a band-like common base end.

The horizontal hinge 61*a* is a horizontal thin piece member, which is thin in thickness as viewed in the vertical direction of the key and extends in the longitudinal direction of the key. The left-to-right hinge 61*b* is a vertical thin piece member, which is thin in thickness in the width direction of the key and extends in the longitudinal direction of the key.

The horizontal hinge 61*a* is connected to the left-to-right hinge 61*b* via a connecting portion 61*c*, and the left-to-right hinge 61*b* is connected to the common base end 62 via a connecting portion 61*d*. Each of the connecting portions 61*c*, 61*d* is formed into a plate piece member having a thickness as viewed in the longitudinal direction of the key and extending in the width direction of the key.

Reference numeral 61*e* denotes a stopper piece member that includes a stopper disposed on the key-frame side for restricting a pivotal range of the key main body 61. In the key unit disclosed in Japanese Patent Publication No. 2628566 (refer to FIG. 1 of the Publication), the stopper piece member 61*e* also functions as a key guide by being inserted into a slit formed in the frame.

When the key main body 61 is deformed in the width direction of the key due to post-molding shrinkage, the horizontal hinge 61*b* is slightly bent and the key main body 61 is pivoted in the width direction of the key so as to correct the position of the key main body. As a result, an inclination of the key in the width direction of the key is adjusted such that the key main body 61 is made perpendicular to the common base end 62.

However, the key main body 61 is connected at its rear end with the common base end 62 extending in the longitudinal direction, via a key-fulcrum function device having a horizontal hinge 61*a* extending in the longitudinal direction. Thus, the keyboard apparatus is long in the depth direction. For this reason, an electronic keyboard instrument accommodating the keyboard apparatus is also long in the depth direction.

A space for mounting a switch and the like is required below the common base end 62 whose upper part is covered by an instrument body panel. For this reason, the instrument body panel must be disposed sufficiently above the common base end 62, which causes a problem.

Another type of keyboard apparatus has been known in which a vertical hinge is used as a key-fulcrum function device (refer to Japanese Utility Model Registration Publication No. 6-31507).

Keys forming a key unit have intermediate portions thereof (at which a rear surface of a black key is present) as viewed in the longitudinal direction. At the intermediate portion of each of the keys, there is formed a vertical hinge comprised of a thin plate piece member, which is thin in the longitudinal direction of the key and which extends downward of the key. The vertical hinge functions to permit a distal end of the key to be pivotable in the key depression/release direction. The vertical hinge is coupled to and integrally molded with a band-like common base end, which is placed on the same plane as the vertical hinge. In the keyboard apparatus disclosed in Japanese Utility Model Registration Publication No. 6-31507, the keys each have a rear portion thereof provided with a weight or formed into a shape in contact with a lever to which a weight is fixed. Therefore, the key main bodies are extended rearward beyond positions at which rear surfaces of black keys are located.

If the rear ends of the keys are not extended rearward but are extended downward to form vertical hinges, the keyboard apparatus can be shortened in the longitudinal direction of the keys as compared to using horizontal hinges.

At that time, if the vertical hinges are extended downward sufficiently in length, the vertical hinges are capable of being deformed while being twisted when applied with a force exerting in the width direction of the keys, making it possible to broaden a movable range thereof. However, in that case, since the vertical hinges move while being obliquely twisted, a stress is concentrated at root portions of the vertical hinges, thus the durability of the vertical hinges is deteriorated. In addition, rolling motions of the vertical hinges are liable to occur, producing mechanical noise due to the contact of the vertical hinges with adjacent key main bodies or key guides, which causes a problem.

SUMMARY OF THE INVENTION

The present invention provides a keyboard apparatus of an electronic keyboard instrument which is compact in size and broad in a permissible movable range at the time of receiving a force exerting in a width direction of keys.

According to the present invention, there is provided a keyboard apparatus of an electronic keyboard instrument comprising a plurality of keys constituting at least one key unit and formed integrally with one another by being connected in a rear of key main bodies to a common base end via key-fulcrum function devices that permit the keys to be pivotable in a key depression/release direction, and a key frame to which the common base end is fixed, wherein each of the key-fulcrum function devices includes a vertical hinge and a left-to-right hinge that are coupled to each other, the vertical hinge is formed into a thin plate-like piece member that is thin in a longitudinal direction of the keys, extends downward of the keys, and that permits a distal end of the key concerned to be pivotable in the key depression/release direction, the left-to-right hinge is formed into a thin plate-like piece member that is thin in a width direction of the keys, extends in the longitudinal direction of the keys, and permits the distal end of the key concerned to be displaceable in the width direction of the keys, one of the vertical hinge and the left-to-right hinge is connected to a rear portion of the key main body concerned, and another of the vertical hinge and the left-to-right hinge is coupled to the common base end.

With the above construction, as key fulcrums permitting the distal ends of the keys to be pivotable in the key depression/release direction, the vertical hinges are employed instead of horizontal hinges, and therefore, the lengths of the key-fulcrum function devices in the longitudinal direction of the keys can be shortened.

Since the key-fulcrum function devices are provided at rear ends of the key main bodies, it is possible to shorten the length of the keyboard apparatus in the depth direction.

Furthermore, since the left-to-right hinges are employed in combination with the vertical hinges, a permissible movable range of each of the keys is broadened at the time when a force exerting in the width direction of the keys is applied to the key, and at the same time it is possible to relax a stress applied to the vertical hinge when the key is applied with a force exerting in the width direction thereof.

Each of the key-fulcrum function devices can be formed below a back surface of an upper surface portion of the key main body concerned, and at least part of the key-fulcrum function device can be formed at a location closer to the distal end of the key main body than to the rear end of the key main body.

In that case, at least part of the key-fulcrum function device is formed at a location closer to the distal end of the key main body than to the rear end of the key main body, whereby the depth size of the keyboard apparatus can be shortened.

The common base end can be formed into a band shape that is thin in the longitudinal direction of the keys and extends along the width direction of the keys. The left-to-right hinge can be coupled to the key main body concerned so as to be apart downward from the back surface of the upper surface portion of the key main body. The vertical hinge can be coupled with the left-to-right hinge and the common base end in the rear of the rear end of the key main body.

In that case, since the common base end is thin in the longitudinal direction of the keys, the lengths of the keys in the longitudinal direction can be shortened. Since the vertical hinges are disposed in the rear of the rear ends of the key main bodies, it is easy to form the left-to-right hinges and the vertical hinges coupled thereto.

The present invention having the above described construction produces effects of broadening permissible movable ranges of the keys in a case where there is applied a force exerting in the width direction of the key due to a design error of the key frame, post-molding shrinkage, or the like, improving the durability of the key-fulcrum function devices by relaxing a stress generated therein, and shortening the depth sizes of the key-fulcrum function devices and the keyboard apparatus. In the case of being applied to an electronic keyboard instrument, the present invention produces effects of providing a broad empty space below an instrument body panel of the keyboard apparatus and shortening the depth size of the electronic keyboard instrument.

Further features of the present invention will become apparent from the following description of exemplary embodiments with reference to the attached drawings.

BRIEF DESCRIPTION OF THE DRAWINGS

FIGS. 2A to 2D are views for explaining a black key unit, a white key unit, and another white key unit, wherein FIG. 2A is a right side view showing, partly in cross section, the black key unit, FIG. 2B is a right side view of the white key unit, FIG. 2C is a right side sectional view of another white key unit, and FIG. 2D is a bottom view of another white key unit;

FIGS. 4A to 4C are views for explaining a black key unit, a white key unit, and another white key unit according to another embodiment of the present invention, in which FIG. 4A is a right side view of the black key unit, FIG. 4B is a right side view of the white key unit, and FIG. 4C is a right side view of another white key unit;

DETAILED DESCRIPTION OF THE PREFERRED EMBODIMENTS

The present invention will now be described in detail below with reference to the drawings showing preferred embodiments thereof.

Figure 1A:
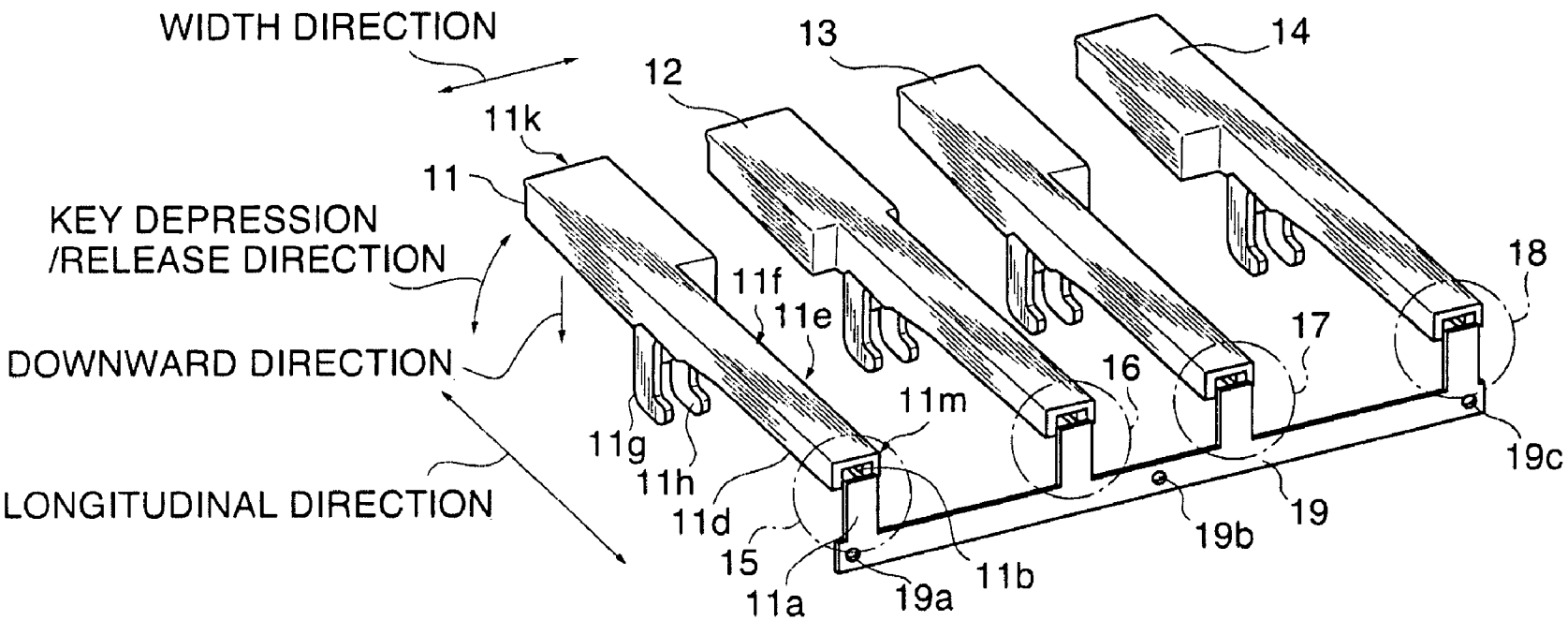
FIGS. 1A and 1B are perspective views of a white key unit according to one embodiment of the present invention.
Figure 1B:
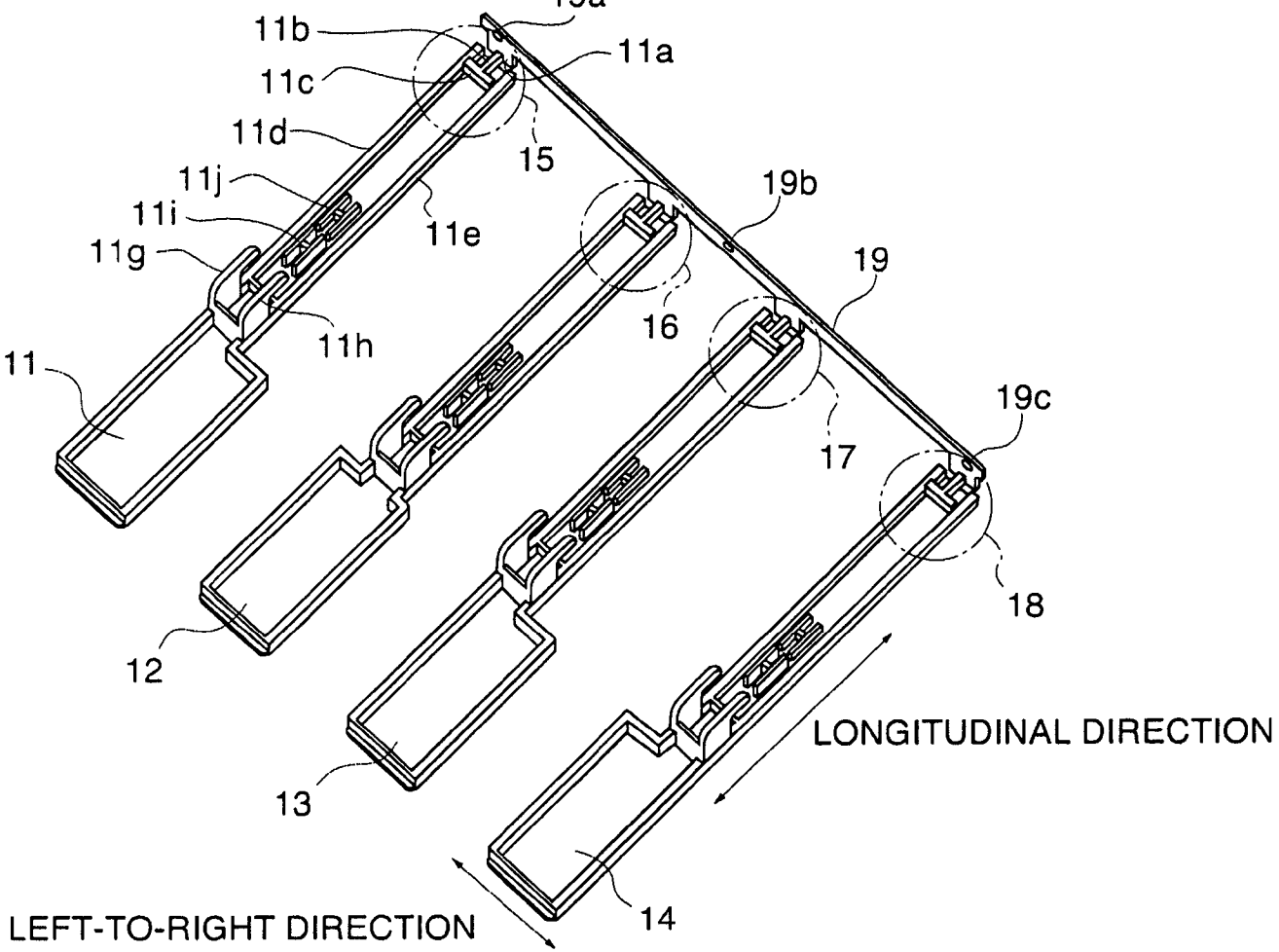

FIGS. 1A and 1B are perspective views of a white unit according to one embodiment of the present invention. In FIG. 1A, a white key unit 1 is seen from a rear side thereof, and in FIG. 1B, the white key unit 1 is seen from a bottom side thereof. A one-octave part of the key unit is illustrated in FIGS. 1A and 1B.

In FIGS. 1A and 1B, reference numerals 11 to 14 denote key main bodies of keys of B, G, E, and C forming the white key unit 1. The key main bodies 11 to 14 are formed with key-fulcrum function devices 15 to 18 that permit the keys to be pivotable in the key depression/release direction, the key-fulcrum function devices 15 to 18 being formed at locations below back surfaces of upper surface portions of the key main bodies 11 to 14 on the rear side thereof. The key-fulcrum function devices 15 to 18 are coupled to a common base end 19, which are integrally formed by resin molding.

The common base end 19 is formed into a band shape that is thin in the longitudinal direction of the keys (the depth direction of the keys) and extends along the width direction of the keys (the left-to-right direction of the keys). The common base end 19, and common base ends 22, 24 of the black key unit 3 and the white key unit 2, which will be described in detail later with reference to FIGS. 2B and 2C, are fixed to a key frame, not shown, using screws or the like, while mounting holes 19*a* to 19*c* being aligned with relevant parts of the key frame.

The keys are the same in construction from one another. In the following, an explanation will be given of the key of B.

The key-fulcrum function device 15 includes a vertical hinge 11*a* and a left-to-right hinge 11*b*.

The vertical hinge 11*a* is formed into a thin plate-like piece member that is thin in the longitudinal direction of the keys, extends downward of the keys (in the vertical direction of the keys), and permits a distal end (free end) 11*k* of the key concerned to be pivotable in the key depression/release direction (in a normal key depression/release operation).

The vertical hinge 11*a* is coupled at its lower end with the band-shaped common base end 19, and the center of a front surface of an upper portion of the vertical hinge portion 11*a* is coupled to a rear end of the left-to-right hinge 11*b*. A lower portion of the vertical hinge portion 11*a*, which is not coupled to the left-to-right hinge 11*b*, functions as a key fulcrum for pivotal motion.

In the illustrated example, the vertical hinge 11*a* and the common base end 19 are the same in thickness from each other and disposed to be flush with each other. The illustrated vertical hinge 11*a* extends vertically downward relative to the key main body 11, but may be disposed to be oblique to the longitudinal direction of the keys.

The left-to-right hinge 11*b* is formed into a thin plate-like piece member that is thin in the width direction of the keys, extends along the longitudinal direction of the keys, and permits the distal end 11*k* of the key to be displaceable in the width direction of the key. The left-to-right hinge 11*b* is thicker in thickness than the vertical hinge 11*a*.

The left-to-right hinge 11*b* has its front end that hides under a back surface of the upper surface portion 11*f* of the key main body 11 and is coupled to the center of a rear surface of the connecting portion 11*c* as shown in FIG. 1B.

The connecting portion 11*c* has a thickness in the longitudinal direction of the keys, is formed into a plate-like piece member extending downward of the keys, and is coupled at its left and right ends with inner side surfaces of side surface portions 11*d*, 11*e*. The detail will be explained with reference to FIG. 2C.

Reference numerals 11*g*, 11*h* denote stopper members extending downward from the right-side and left-side surface portions 11*d*, 11*e* of the key main body 11. Each of the stopper member has its distal end bent into an L shape. Reference numerals 11*i*, 11*j* denote first and second actuators that project from the back surface (ceiling surface) of the upper surface portion 11*f* of the key main body 11 to form an H-shape, and are disposed so as to extend along the longitudinal direction of the keys.

FIGS. 2A to 2D are views for explaining the black key unit 3, the white key unit 2, and the white key unit 1 of this embodiment.

Figure 2A:
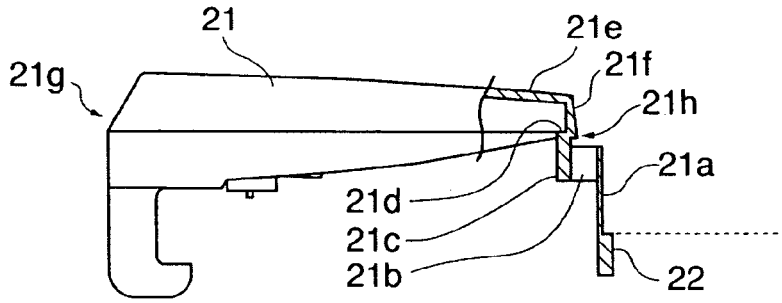
Figure 2B:
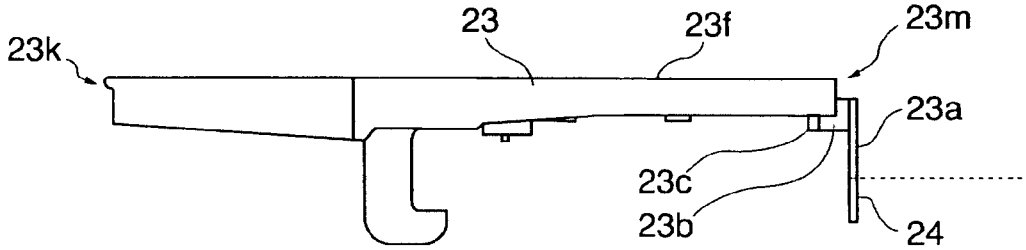
Figure 2C:
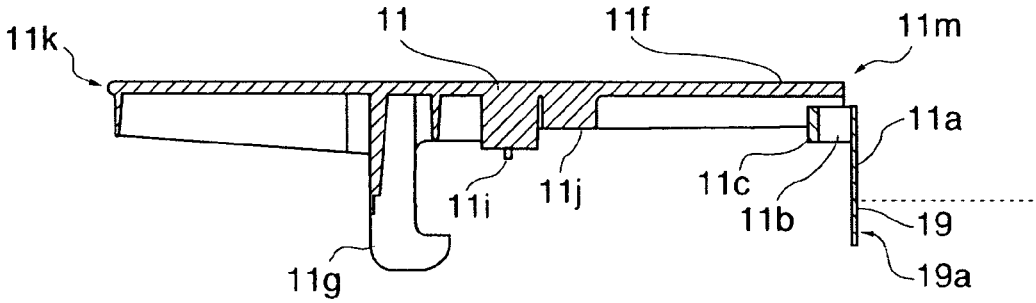

FIG. 2A is a right side view showing, partly in cross section, the black key unit 3.

FIG. 2B is a right side view of the white key unit 2.

Figure 2D:
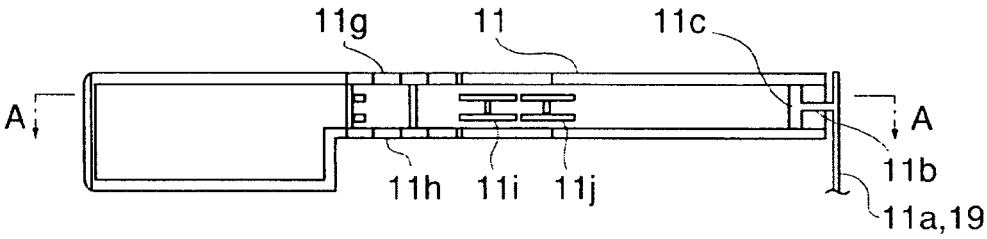

FIG. 2C is a right side sectional view of the white key unit 1, taken along line A-A in a bottom view of the white key unit 1 in FIG. 2D.

First, with reference to FIG. 2C, the construction of the key-fulcrum function device 15 of the white key unit 1 described with reference to FIG. 1 will be further described in detail below.

The connecting portion 11*c* of the key main body 11 is disposed away from the back surface (ceiling surface) of the upper surface portion 11*f* of the key main body 11. This is because, in the arrangement where the connecting portion 11*c* is also coupled to the back surface, there is likely produced a surface sink (recess) on the surface of the upper surface portion 11*f* during the molding. The molding can be carried out by causing a molding die to be slid from the side close to the rear end 11*m* of the key main body 11.

Since the upper ends of the connecting portion 11*c*, the left-to-right hinge 11*b* and the vertical hinge 11*a* are aligned to one another, the key-fulcrum function device 15 is formed downward from the back surface of the upper surface portion 11*f* of the key main body 11.

Figure 6:
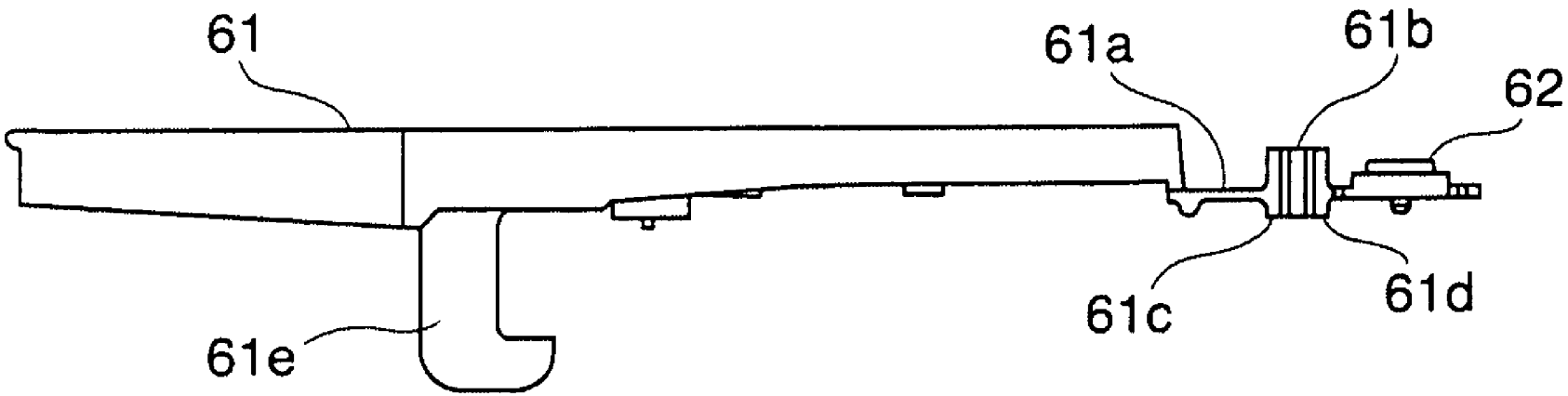
FIG. 6 is a view of a key for explaining another problem of the conventional key unit.

Accordingly, a part of the key-fulcrum function device 15, i.e., at least part of the left-to-right hinge 11*b*, extends into the key main body 11, which makes it possible to shorten the length of the key in the longitudinal direction of the key as compared to the conventional keys shown in FIG. 6.

Although the common base end 19 is made the same in thickness as the vertical hinge 11*a*, the thickness thereof may be thicker than that of the vertical hinge.

Since the vertical hinge 11*a* and the common base end 19 are made thin in the longitudinal direction of the keys, the key-fulcrum function device is also shortened in that direction as compared to the conventional keys using horizontal hinges as shown in FIG. 6.

The white key unit 2 shown in FIG. 2B is comprised of three keys of D, F, and A. A vertical hinge 23*a*, a left-to-right hinge 23*b*, and a connecting portion 23*c* of the white key unit 2 may be the same in shape and dimension as the vertical hinge 11*a*, the left-to-right hinge 11*b*, and the connecting portion 11*c* of the white key unit 1 shown in FIG. 2C.

It should be noted that since a common base end 24 must be superimposed on the right side of the common base end 19 shown in FIG. 2C, the common base end 24 is shifted in position toward a rear end portion 23*m* by the thickness of the common base end 19.

The black key unit 3 shown in FIG. 2A includes key-fulcrum function devices slightly different from those for the white key units 1, 2. Since a key main body 21 has its rear surface portion 21*f*, it is difficult due to limitation in die fabrication for a connecting portion 21*c* to be formed near the rear surface portion 21*f* in the key main body 21.

For this reason, a bottom surface portion 21*d* of the key main body 21 is formed so as to horizontally extend from lower ends of the rear end portion 21*h* and the rear surface portion 21*f* in the direction toward a distal end portion 21*g* of the key main body 21. Further, the connecting portion 21*c* is formed so as to extend downward from an end of the bottom surface portion 21*d* on the side close to the distal end portion 21*g*. By forming the bottom surface portion 21*d*, the key-fulcrum function device is disposed at a location closer to the distal end portion 21*f*.

The connecting portion 21*c* is formed into a plate-like piece member that has a thickness in the longitudinal direction of the keys and extends downward of the keys. The connecting portion 21*c* may have a width substantially equal to an inner width between left and right side surface portions of the key main body 21. A left-to-right hinge 21*b* is coupled to the center of a rear surface of the connecting portion 21*c*, and a left-to-right hinge 21*a* is coupled to the center of a front surface of an upper portion of the vertical hinge 21*a*.

A lower end of the vertical hinge 21*a* is coupled to the common base end 22. A lower portion of the vertical hinge 21*a* that is not coupled to the left-to-right hinge 21*b* functions as a key fulcrum for pivotal motion.

The common base end 22 is formed into a band shape that is thin in the longitudinal direction of the keys and extends along the width direction of the keys. Although the thickness of the common base end is made larger than that of the vertical hinge 21*a*, it may be equal to the thickness of the vertical hinge.

In the case of a black key in which the construction of the key-fulcrum function device becomes complicated, a simpler construction may be adopted. For example, the connecting portion 21*c* may be directly coupled to the lower end of the rear end portion 21*h* from below, without the bottom surface portion 21*d* being provided.

Figure 3:
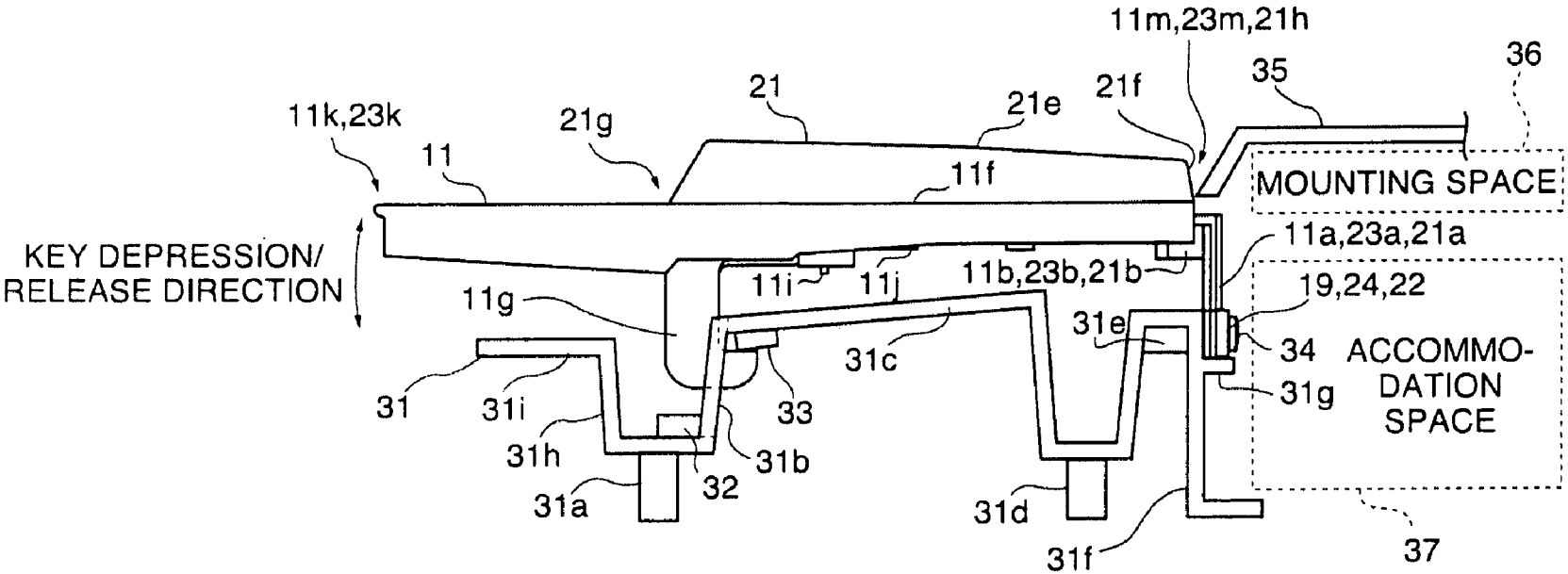
FIG. 3 is a right side view showing the keyboard apparatus in an assembled state in which the key units shown in FIGS. 2A to 2D are assembled together.

FIG. 3 is a right side view showing a keyboard apparatus in an assembled state where the key units shown in FIGS. 2A to 2D are assembled together.

In FIG. 3, like elements similar to those shown in FIGS. 1A, 1B, and 2A to 2D are denoted by like reference numerals, with an explanation thereof omitted below.

Reference numeral 31 denotes a key frame which is integrally formed by resin molding or is formed by a composite material of resin and a material other than resin (for example, metal). Reference numerals 31*a* and 31*d* denote screw boss portions for use when the key frame 31 is mounted to a lower housing of an electronic keyboard instrument.

Reference numeral 31*b* denotes a frame step difference portion formed with a slit into which lower distal ends of stopper members (one of which is denoted by 11*g*) are inserted. A lower limit stopper 32 and an upper limit stopper 33 are provided for the stopper members.

Reference numeral 31*c* denotes a slant surface portion on which a board unit, not shown, is disposed. Two key switches such as, for example, dome-shaped on-off sensors having elasticity are disposed on the board unit. When the key main body 11 is depressed, the key switches are turned on with time difference by means of actuators 11*i*, 11*j*.

The common base ends 19, 24, and 22 shown in FIG. 2 are stacked together in this order from the common base end on the left side in the illustration, and are mounted and fixed to a rear end wall 31*f* of the frame using screws 34, while mounting holes formed in the common base ends being aligned with relevant parts of the frame. Reference numeral 31*e* denotes screw bosses for the screws 34. Reference numeral 31*g* denotes a base end support by which lower ends of the common base ends 19, 24, and 22 are aligned.

Reference numeral 35 denotes an instrument body panel that covers a keyboard surface located in the rear of the rear surface portion 21*f* of the black key. Rear end portions 11*m*, 23*m*, and 21*h* of the keys are positioned at locations slightly rearward of the rear surface portion 21*f* of the black key, and therefore, are covered by the instrument body panel 35. A keyboard surface exposed from the instrument body panel 35 is called a key external surface.

In the illustrated example, the stopper member 11*g* (ditto in the case of the stopper member 11*h*) of the key main body 11 has a lower portion whose distal end projects toward the rear of the keys (toward the rear end portion 11*m*), and is formed into an L shape as viewed in the illustrated right side view.

Alternatively, the stopper members 11*g* and 11*h* may each have a lower distal end thereof formed so as to project toward the front side of the keys (toward the distal end 11*k*). In that case, a slit is formed in the frame front step difference portion 31*h* and the shape and dimension of the key frame 31 are changed so that the lower distal ends of the stopper members are inserted into the slit. The upper stopper 33 is disposed on the back surface of a forward horizontal surface portion 31*i* of the key frame 31, in which upper portions of lower distal ends of the stopper members are made in contact when the key concerned is not depressed, whereas the lower stopper 32 is disposed at a position so that the lower ends of the stopper members 11*g*, 11*h* are in contact therewith when the distal end 11*k* of the key is depressed to the maximum limit.

The above described modification of the stopper members 11*g*, 11*h*, the relevant alterations of the shape and dimension of the key frame 31, and the arrangement of the upper and lower limit stoppers 33, 32 are also applicable to the keys of the black key unit 3 and the white key unit 2 having been described with reference to FIGS. 2A and 2B. Furthermore, the modified stopper members, the relevant alterations, and the stopper arrangement are applicable to the keys of a second embodiment of this invention, which will be described later with reference to FIG. 4.

An empty space below the instrument body panel 35 can be ensured by the illustrated arrangement, in which the key-fulcrum function devices (the vertical hinges 11*a*, 23*a*, 21*a* and the left-to-right hinges 11*b*, 23*b*, 21*b*) are provided at locations rearward of the key main bodies 11, 23, 21 and below the back surfaces of the upper surface portions 11*f*, 23*f*, 21*e* of the key main bodies, and at least parts of the key-fulcrum function devices are formed at locations on the side closer to the distal end portions than to the rear end portions 11*m*, 23*m*, 21*h* (in a more strict sense, a rear end of the above described key external surface) of the key main bodies, and no key function members (such as, for example, actuators and/or piano action mechanisms) are provided in the rear of the key-fulcrum function devices.

In the empty space, it is possible to provide a mounting space 36 for operators or switches to be mounted to the instrument body panel 35 and/or provide an accommodation space 37 for a main board, a battery casing, or the like.

In a case where the mounting space 36 and/or the accommodation space 37 is the same in volume as that of conventional products, the depth size of the electronic keyboard instrument can be shortened.

It should be noted that pivotal fulcrums of the key main bodies 11, 23, and 21 are formed by those lower portions of the vertical hinges 11*a*, 23*a*, and 21*a* which are not coupled to the left-to-right hinges 11*b*, 23*b*, and 21*b*. These pivotal fulcrums are located below the key main bodies 11, 23, and 21. When a player depresses the distal end portion 11*k*, 23*k*, or 21*g*, the depressed distal end is therefore moved toward the player, and no uncomfortable feelings are caused during the musical performance.

Figure 4A:
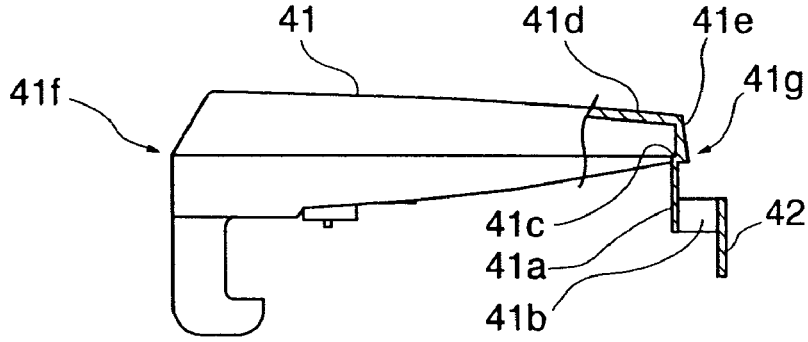
Figure 4B:
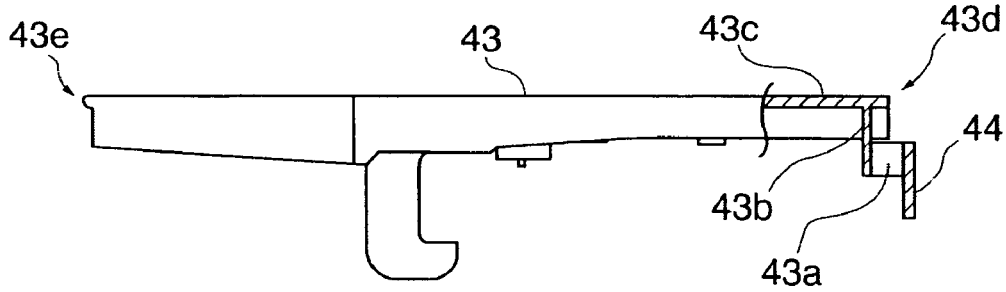
Figure 4C:
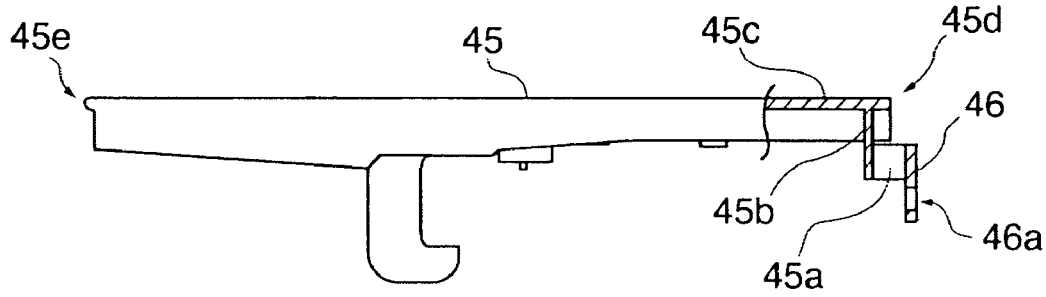
Figure 5A:
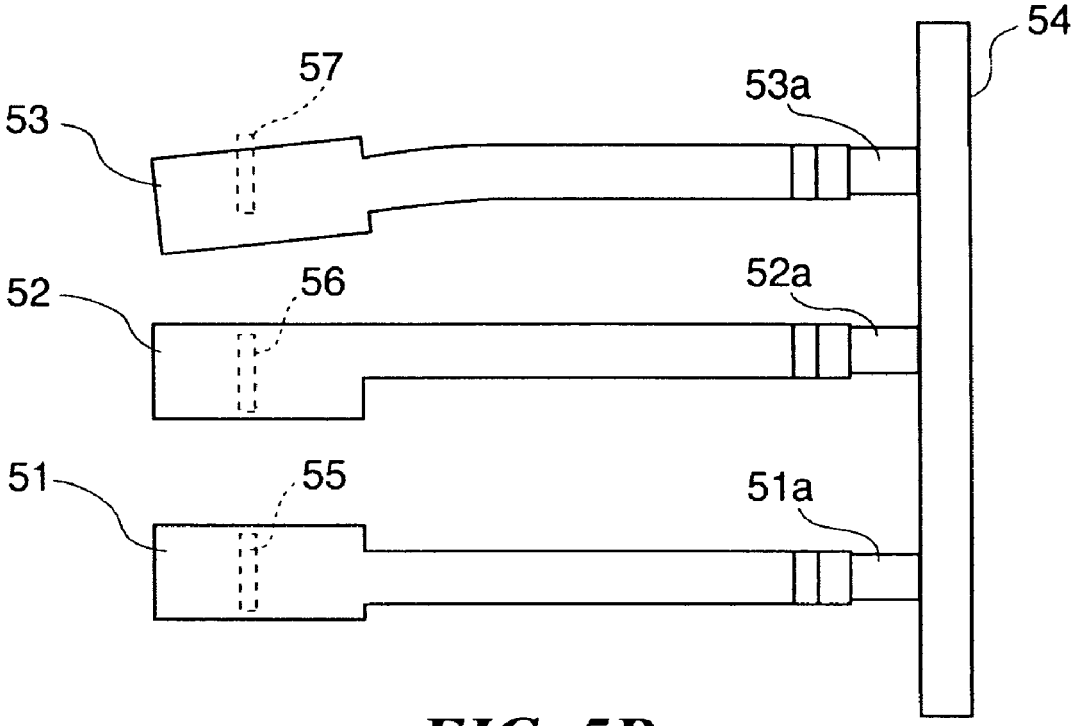
FIGS. 5A and 5B are schematic views for explaining a problem of a conventional key unit.
Figure 5B:
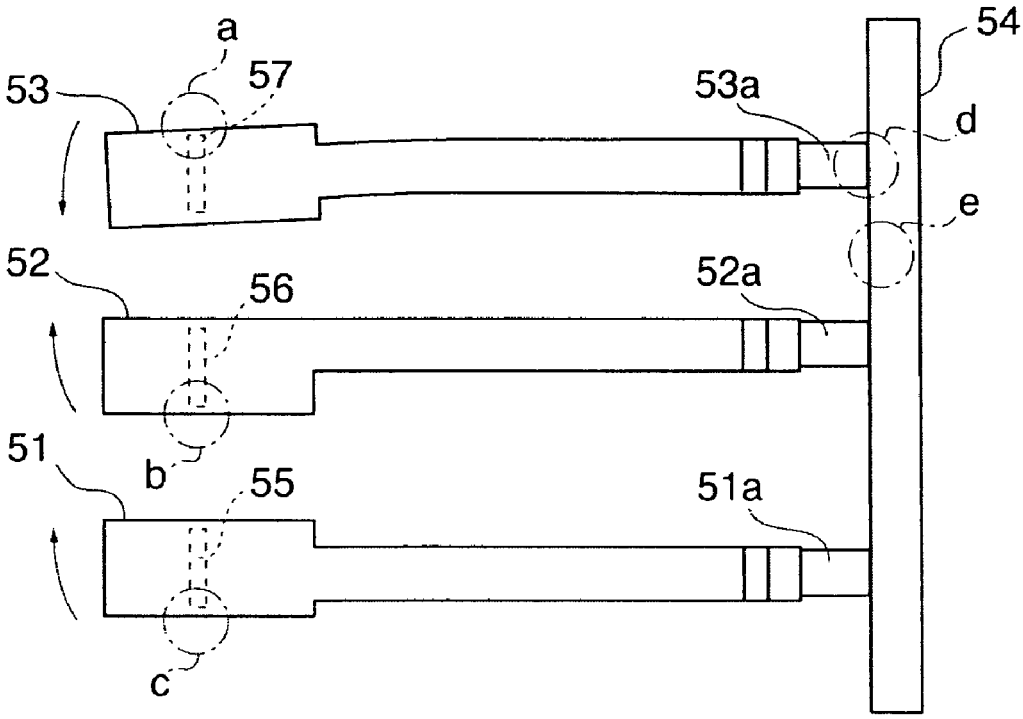

FIGS. 4A to 4C are views for explaining a key unit according to another embodiment of this invention.

FIG. 4A is a right side view of a black key unit 3, FIG. 4B is a right side view of a white key unit 2, and FIG. 4C is a right side view of a white key unit 1. In each of these figures, there is shown the structure of a rear portion of the key unit in cross section.

In this embodiment, the arrangement relation between a vertical hinge and a left-to-right hinge forming a key-fulcrum function device is reversed as compared to the above described embodiment.

First, with reference to FIG. 4C, an explanation will be given of the key-fulcrum function device of the white key unit 1.

Reference numeral 45 denotes a key main body of a key forming part of the white key unit 1. A key-fulcrum function device is formed on a rear side of the key main body 45 below a back surface of an upper surface portion of the key main body 45. The key main body 45 is coupled via the key-fulcrum function device to a common base end 46, which are integrally formed by resin molding. The common base end 46 is formed into a band shape that is thin in the longitudinal direction of the key and extends along the width direction of the key.

A vertical hinge 45*b* is formed into a thin plate-like piece member that is thin in the longitudinal direction of the key, extends downward of the key, and permits a distal end portion 45*e* of the key to be pivotable in the key depression/release direction. The vertical hinge 45*b* has its upper end coupled to a back surface (ceiling surface) of the upper surface portion 45*c* of the key main body 45. Slits are formed between the vertical hinge 45*b* and left and right side surface portions of the key, and the vertical hinge 45*b* is spaced apart from inner side surfaces of the left and right side surface portions of the key.

Although the illustrated vertical hinge 45*b* extends vertically downward relative to the key main body 45, the vertical hinge may extend obliquely in the longitudinal direction of the key.

A left-to-right hinge 45*a* is formed into a thin plate-like piece member that is thin in the width direction of the key, extends in the longitudinal direction of the key, and permits the distal end portion 45*e* of the key to be displaceable. The left-to-right hinge 45*a* has an upper end thereof located below lower ends of the left and right side surface portions of the key. The left-to-right hinge 45*a* has a front end thereof coupled to the center of a rear surface of a lower portion of the vertical hinge 45*b*, and has a rear end thereof coupled to an upper portion of a front surface of the band shaped common base end 46.

The vertical hinge 45 has its lower portion not coupled to the left-to-right hinge 45*a* and functioning as a key fulcrum for pivotal motion.

The white key unit 2 shown in FIG. 4B has a key main body 43 whose key-fulcrum function device is the same as the key-fulcrum function device shown in FIG. 4C. The shapes and dimensions of a left-to-right hinge 43*a* and a vertical hinge 43*b* of the white key unit 2 may be the same as the left-to-right hinge 45*a* and the vertical hinge 45*b* of the white key unit 1.

It should be noted that the position of a common base end 44 is shifted toward a rear end portion 43*d* of the key by a thickness of the common base end 46.

In a black key unit 3 shown in FIG. 4A, a key-fulcrum function device includes a vertical hinge 41*a* extending downward from that end of a bottom surface portion 41*c* of a key main body 41 which is on the side close to a distal end portion 41*f*, the bottom surface portion 41*c* being horizontally formed from lower ends of a rear end portion 41*g* and a rear surface portion 41*e* of the key main body 41 in the direction toward a distal end portion 41*f* of the key concerned. Lower ends of left and right side surface portions of the key obliquely extend in the longitudinal direction and are not present in the bottom surface portion 41*c*. For this reason, the illustrated vertical hinge 41*a* extends vertically downward relative to the key main body 41, without being coupled to the left and right side surface portions of the key. The vertical hinge 41*a* may be extended obliquely in the longitudinal direction of the key.

A left-to-right hinge 41*b* has a front end thereof coupled to the center of a lower portion of a rear surface of the vertical hinge 41*a*, and has a rear end thereof coupled to an upper portion of a front surface of a band-shaped common base end 42.

The vertical hinge 41 has a lower portion thereof not coupled to the left-to-right hinge 41*b*, and such a lower portion of the vertical hinge 41 functions as a key fulcrum for pivotal motion.

The common base end 42 is formed into a band shape that is thin in the longitudinal direction of the key and extends along the width direction of the key.

It should be noted that the vertical hinge 41*a* may be directly coupled to and extended from a lower end of a rear portion 41*g* of the key main body 41, without the bottom surface portion 41*c* being formed in the key main body 41.

The thicknesses of left-to-right hinges 45*a*, 43*a*, 41*b* are made thicker than those of the vertical hinges 45*b*, 43*b*, 41*a*.

Although the common base ends 46, 44, 42 of the keys units are made to have thicknesses thicker than those of the vertical hinges 45*b*, 43*b*, 41*a*, the thicknesses of the common base ends may be set equal to those of the vertical hinges.

The above described common base ends 46, 44, 42 are fixed to the key frame 31 using screws or the like, while mounting holes (including a hole 46*a*) formed in the common base ends being aligned with relevant parts of the key frame, as in the aforementioned embodiment.

Also in the present embodiment, the left-to-right hinges 45*a*, 43*a*, and 41*b* are positioned below the vertical hinges 45*b*, 43*b*, and 41*a*, and therefore, the key-fulcrum function devices are formed below the upper surface portions 45*c*, 43*c*, 41*d* of the key main bodies 45, 43, and 41. As a result, a space for mounting component parts to the instrument body panel 35 can be ensured without the need of sufficiently separating the key main bodies apart from the instrument body panel.

Parts of the key-fulcrum function devices are formed at locations closer to the distal end portions 45*e*, 43*e*, 41*f* of the key main bodies than to the rear end portions 45*d*, 43*d*, 41*g* thereof. Thus, the size of the keyboard apparatus in the longitudinal direction of the keys can be shortened as compared to the conventional keyboard apparatus, and an accommodation space can be increased in volume.

In the above, the key main bodies each having two actuators have been described. However, each of the key main bodies may be provided with one actuator. An after-touch sensor for detecting an amount of depression of a key may be provided for an after-touch control in each key main body.

In the above, the key unit having one-octave keys that are divided into three have been described. However, the key unit may have more than one-octave keys and may be divided into a desired number of units other than three.

What is claimed is:

1. A keyboard apparatus of an electronic keyboard instrument, comprising a plurality of keys constituting at least one key unit and formed integrally with one another by being connected in a rear of key main bodies to a common base end via key-fulcrum function devices that permit the keys to be pivotable in a key depression/release direction, and a key frame to which the common base end is fixed, wherein:

each of the key-fulcrum function devices includes a vertical hinge and a left-to-right hinge that are coupled to each other;

the vertical hinge is formed into a thin plate-like piece member that is thin with respect to a longitudinal direction of the keys, extends downward of the keys, and that permits a distal end of the key concerned to be pivotable in the key depression/release direction;

the left-to-right hinge is formed into a thin plate-like piece member that is thin with respect to a width direction of the keys, extends in the longitudinal direction of the keys, and permits the distal end of the key concerned to be displaceable in the width direction of the keys; and one of the vertical hinge and the left-to-right hinge is connected to a rear portion of the key main body concerned, and another of the vertical hinge and the left-to-right hinge is coupled to the common base end.

2. The keyboard apparatus according to claim 1, wherein each of the key-fulcrum function devices is formed below a back surface of an upper surface portion of the key main body concerned, and at least part of the key-fulcrum function device is formed at a location closer to the distal end of the key main body than to the rear end of the key main body.

3. The keyboard apparatus according to claim 2, wherein the common base end is formed into a band shape that is thin with respect to the longitudinal direction of the keys and extends along the width direction of the keys, the left-to-right hinge is coupled to the key main body concerned so as to be apart downward from the back surface of the upper surface portion of the key main body, and the vertical hinge is coupled with the left-to-right hinge and the common base end in the rear of the rear end of the key main body.

* * * * *